US005143357A

United States Patent [19]

Gilbert et al.

[11] Patent Number: 5,143,357

[45] Date of Patent: Sep. 1, 1992

[54] MELTING METAL PARTICLES AND DISPERSING GAS WITH VANED IMPELLER

[75] Inventors: Ronald E. Gilbert, Chardon; George S. Mordue, Ravenna, both of Ohio

[73] Assignee: The Carborundum Company, Niagara Falls, N.Y.

[21] Appl. No.: 614,914

[22] Filed: Nov. 19, 1990

[51] Int. Cl.[5] ..... C21C 7/00

[52] U.S. Cl. ..... 266/235; 75/708

[58] Field of Search ..... 75/708; 266/235

[56] References Cited

U.S. PATENT DOCUMENTS

| | | | |
|---|---|---|---|
| 3,871,872 | 3/1975 | Downing | 266/235 |
| 3,915,694 | 10/1975 | Ando | 75/566 |
| 4,018,598 | 4/1977 | Markus | 75/560 |
| 4,058,394 | 11/1977 | Crimes | 266/166 |
| 4,066,722 | 1/1978 | Pietruszewski | 261/87 |
| 4,425,232 | 1/1984 | Lawrence | 210/219 |
| 4,598,899 | 7/1986 | Cooper | 266/212 |
| 4,634,105 | 1/1987 | Withers | 266/217 |
| 4,747,583 | 5/1988 | Gordon | 266/235 |
| 4,802,656 | 2/1989 | Hudault | 266/225 |
| 4,884,786 | 12/1989 | Gillespie | 266/235 |

OTHER PUBLICATIONS

A. R. Anderson, Practical Observations Rotary Impeller Degassing, 91st. AFS Casting Congress (Apr. 6–10, 1987).

*Primary Examiner*—Peter D. Rosenberg

*Attorney, Agent, or Firm*—Larry W. Evans; David J. Untener; Scott A. McCollister

[57] ABSTRACT

Metal particles are melted by mixing them with molten metal contained in a bath. A shaft-supported, rotatable impeller is immersed into the molten metal and rotated so as to establish a vortex-like flow of molten metal. Metal particles are deposited onto the surface of the molten metal in the vicinity of the rotating impeller. The particles are submerged substantially immediately after being deposited onto the surface of the molten metal. The impeller includes a thin rectangular prism having sharp-edged corners and vanes that extend upwardly from the prism. The impeller also can be used to disperse gas into the molten metal by pumping the gas through a bore extending the length of the shaft and out of the impeller along the lower surface of the impeller. The gas is sheared into finely divided bubbles as it rises along the sides of the impeller.

17 Claims, 4 Drawing Sheets

MELTING METAL PARTICLES AND DISPERSING GAS WITH VANED IMPELLER

BACKGROUND OF THE INVENTION

1. Reference to Related Patent

The present application is related to U.S. application Ser. No. 473,489, filed Feb. 2, 1990, by Paul V. Cooper, entitled "Melting Metal Particles," (hereinafter the "Melting Metal Particles Patent"), and now abandoned, which is a continuation-in-part of U.S. Pat. No. 4,898,367, application Ser. No. 222,934, filed Jul. 22, 1988, by Paul V. Cooper, entitled "Dispersing Gas into Molten Metal," (hereinafter the "Dispersing Gas Patent"), the disclosures of which are incorporated herein by reference.

2. Field of the Invention

The invention relates to melting metal particles and, more particularly, to techniques for rapidly melting scrap particles of light metals such as aluminum and to dispersing gas therein.

3. Description of the Prior Art

Light gauge, low density scrap metal particles such as chips, borings, and turnings are produced as a by-product of many metal processing operations. A significant amount of scrap metal also exists in the form of metal cans, particularly aluminum cans and used beverage containers. For convenience, all such scrap metal will be referred to herein as "scrap metal" and "particles." In order to recover the scrap metal for productive use, it is necessary to remelt it. Unfortunately, a number of problems are presented when scrap metal is attempted to be remelted. These problems are particularly acute in the case of light metal such as aluminum due to the tendency of the metal to oxidize when melted. The problems are worse for small particles of scrap metal than large ones, because (1) small particles have a relatively large surface-to-volume ratio and (2) small, lightweight particles tend to remain on the surface of a melting bath where they are oxidized while large, heavier particles sink rapidly beneath the surface without oxidizing.

Reverberatory furnaces have been used to melt scrap metal, but it has been necessary to use mechanical puddlers to achieve respectable recovery rates when small particles of scrap metal are being melted. Puddlers are expensive, bulky, mechanically complex, and are a source of iron contamination. Even with mechanical puddlers, melting of the scrap metal occurs slowly so that the metal tends to oxidize before it melts, resulting in recovery rates that are less than desirable. "Recovery rate" as used herein can be defined as follows:

$$\frac{(\text{Scrap Input Weight} \times \text{Moisture Factor}) - \text{Good Ingot Weight}}{(\text{Scrap Input Weight} \times \text{Moisture Factor})} \times 100$$

The situation is improved when induction furnaces are used. Strong inductive currents are set up in the molten metal which create a stirring action that rapidly submerges the scrap metal before additional oxide can form on the surface. Furthermore, the absence of high temperature combustion produces little or no oxide formation. The result is that recovery rates on the order of 97 percent can be attained. The chief drawback of the induction furnace melting technique is the high initial cost of the furnace and its relative small capacity with respect to a reverberatory furnace. The cost can be so great as to make the scrap recovery process uneconomical despite the high recovery rates available. A further drawback of the induction furnace melting technique is that it is a batch process, rather than a continuous process.

A different approach to the problem of recovering scrap metal is disclosed in U.S. Pat. No. 3,272,619 (hereafter the '619 patent), to V. D. Sweeney et al., the disclosure of which is incorporated herein by reference. In the '619 patent, molten metal is circulated from a reverberatory furnace, through an external crucible where a vortex is established, and back into the furnace. Melting of scrap metal does not occur in the furnace. Rather, the scrap metal is introduced into the vortex established in the external crucible. As the scrap metal swirls down in the vortex, the scrap metal particles eventually are melted. By appropriate control of such parameters as the temperature of the molten metal being circulated, the moisture content of the particles, and the rate at which the particles are fed into the crucible, recovery rates of about 90 percent can be attained.

Although the system described in the '619 patent has been reasonably effective, certain problems remain. The '619 patent states that the intensity of the vortex can be adjusted to produce desired submerging rates, but such adjustment has proven difficult to achieve in practice. The high surface tension of the molten metal in the crucible permits solid particles to remain on the surface of the vortex completely down into the return pipe to the furnace. The result is that solids and air can reach the furnace, with a consequent lowering of melting efficiency. In effect, the scrap metal being melted is exposed excessively to air such that undesired quantities of dross are formed. It is possible that oxide-covered metal drops (referred to hereafter as "agglomerations") can pass completely through the crucible and back into the furnace. An additional concern related to the device according to the '619 patent is the sensitivity of the crucible to flow variations. Because the crucible is most efficient with metal flowing near the top, a slight increase in flow rate can cause a spillover. Additionally, such a high operating level in the crucible can cause loss of through the crucible itself.

The apparatus disclosed in U.S. Pat. No. 4,747,583, issued May 31, 1988 to Gordon, et al. represents an improvement over the device ac to the '619 patent. In the '899 patent, metal particles are mixed with molten metal flowing in a vortex in a crucible by means of stationary blades that project radially outwardly from a vertically-oriented sleeve disposed within the crucible. The blades are arranged relative to the surface of the molten that particles deposited onto the surface of the molten are submerged substantially immediately after being into the flow of molten metal. This result is brought about by encountering the blades which cause the molten metal, with the particles entrained therewith, to be deflected downwardly.

In U.S. Pat. No. 4,598,899, issued Jul. 8, 1986 to Paul V. Cooper, melting of scrap metal particles is accomplished by disposing an auger in a bath of molten metal, rotating the auger so as to draw molten metal downwardly into the auger, and depositing metal particles onto the surface of the molten metal bath. By virtue of the action of the auger, the particles are drawn downwardly, through the auger, where they are forced into intimate contact with the molten metal and thereby are melted. Although the device disclosed in the '899 patent is very effective, certain concerns are not addressed. The auger disclosed in the '899 patent is a so-called shrouded auger, that is, it includes a plurality of radially extending blades, or flutes, that are surrounded by a hollow cylinder at their outermost ends. The relatively complex shape of the auger makes it relatively expensive and difficult to manufacture. The auger additionally is somewhat sensitive to the depth of molten metal in the bath, and the spaces defined by the blades and the surrounding hollow cylinder have the potential to become clogged with metal particles.

The device disclosed in the Melting Metal Particles Patent represents an improvement over the device according to the '899 patent. In the Melting Metal Particles Patent, a shaft-supported, rotatable impeller is immersed into a bath of molten metal and is rotated. Rotation of the impeller establishes a vortex-like flow. Metal particles are deposited onto the surface of the molten metal in the vicinity of the impeller. Due to the action of the vortex, the metal particles are submerged almost immediately.

The particular impeller used in the Melting Metal Particles Patent has proven very effective. The impeller is in the form of a rectangular prism having sharp-edged corners that provides an especially effective mixing action. The use of a shroud is not required. Due to the simplistic configuration of the impeller, it is inexpensive and reliable, while surprisingly being quite effective in operation.

Although the device disclosed in the Melting Metal Particles Patent is effective in quickly mixing the metal particles with the molten metal, certain concerns have not been addressed. One of these concerns relates to the strength of the vortex that can be established. The impeller in the Melting Meal Particles Patent must be operated relatively close to the surface of the bath in order to establish a strong vortex that will submerge the metal particles effectively.

Desirably, a technique would be available for rapidly mixing metal particles with molten metal that would be (1) inexpensive, (2) usable with a variety of containers (just not a crucible), (3) reliable, (4) long-lived, and (5) effective in its mixing action, particularly by being able to establish a strong vortex at a location relatively deep within a bath of molten metal. It also is desired that any mixer be able to be operated at the lowest possible speed while attaining good mixing results. It also is desired that any such device be configured so that it will be difficult or impossible to clog the device with metal particles.

SUMMARY OF THE INVENTION

In response to the foregoing considerations, the present invention provides a new and improved technique for melting metal particles wherein metal particles are mixed with molten metal contained in a bath and are submerged substantially immediately after being introduced into the molten metal. This result is accomplished by immersing a shaft-supported, rotatable impeller into the molten metal and rotating the impeller. Rotation of the impeller establishes a vortex-like flow. Metal particles then are deposited onto the surface of the molten metal in the vicinity of the impeller. Due to the movement of the molten metal and the impeller, the metal particles are submerged almost immediately.

In the preferred embodiment, the impeller is in the form of a generally plate-like rectangular prism having sharp-edged corners. The impeller includes an upstanding central portion to which the shaft is connected. A plurality of vanes extend radially outwardly from the central portion toward the corners of the prism. The vanes are disposed at right angles to each other, and they also are disposed generally perpendicular to the upper face of the prism. Desirably, the vanes taper from a thicker portion in the region of the central portion to a relatively narrow tip portion that is located at the corners of the prism.

Although the impeller is more complex than that disclosed and claimed in the Melting Metal Particles Patent, it still is relatively simplistic in configuration, thereby being relatively inexpensive to manufacture. The impeller is reliable in operation, and it provides an effective vortex-creating action. An advantage of the present invention is that the impeller can be disposed relatively deep in the bath while still being able to create a strong vortex. Accordingly, more metal particles can be melted in a given period of time than can be melted with prior devices, and the metal particles can be submerged quickly, so as to prevent the formation of undesired dross or other oxidation products.

The impeller according to the invention also cannot be clogged with metal particles due to the absence of orifices that can be clogged. In addition, the particular arrangement of the vanes relative to the plate-like prism insures that the vanes are supported adequately. Further, because the vanes project from the hub without any gaps therebetween, the inner portion of the vanes will break up any backflow of gas that may come out of solution during operation.

The impeller according to the invention also can be used to disperse gas into the molten metal. If such a result is desired, the techniques disclosed and claimed in the Dispersing Gas Patent can be utilized to provide in situ metal refining during scrap melting by using a gaseous refining agent (unlike other purely scrap submergence devices). In order to accomplish such a result, a longitudinal opening can be formed within the shaft, which opening extends through an opening formed in the bottom face of the impeller. Gas can be pumped through the shaft and out of the impeller along the lower face thereof. In such a circumstance, the impeller will shear the gas into finely divided bubbles as the gas rises along the sides of the rotating impeller.

DESCRIPTION OF THE PREFERRED EMBODIMENT

Figure 1:
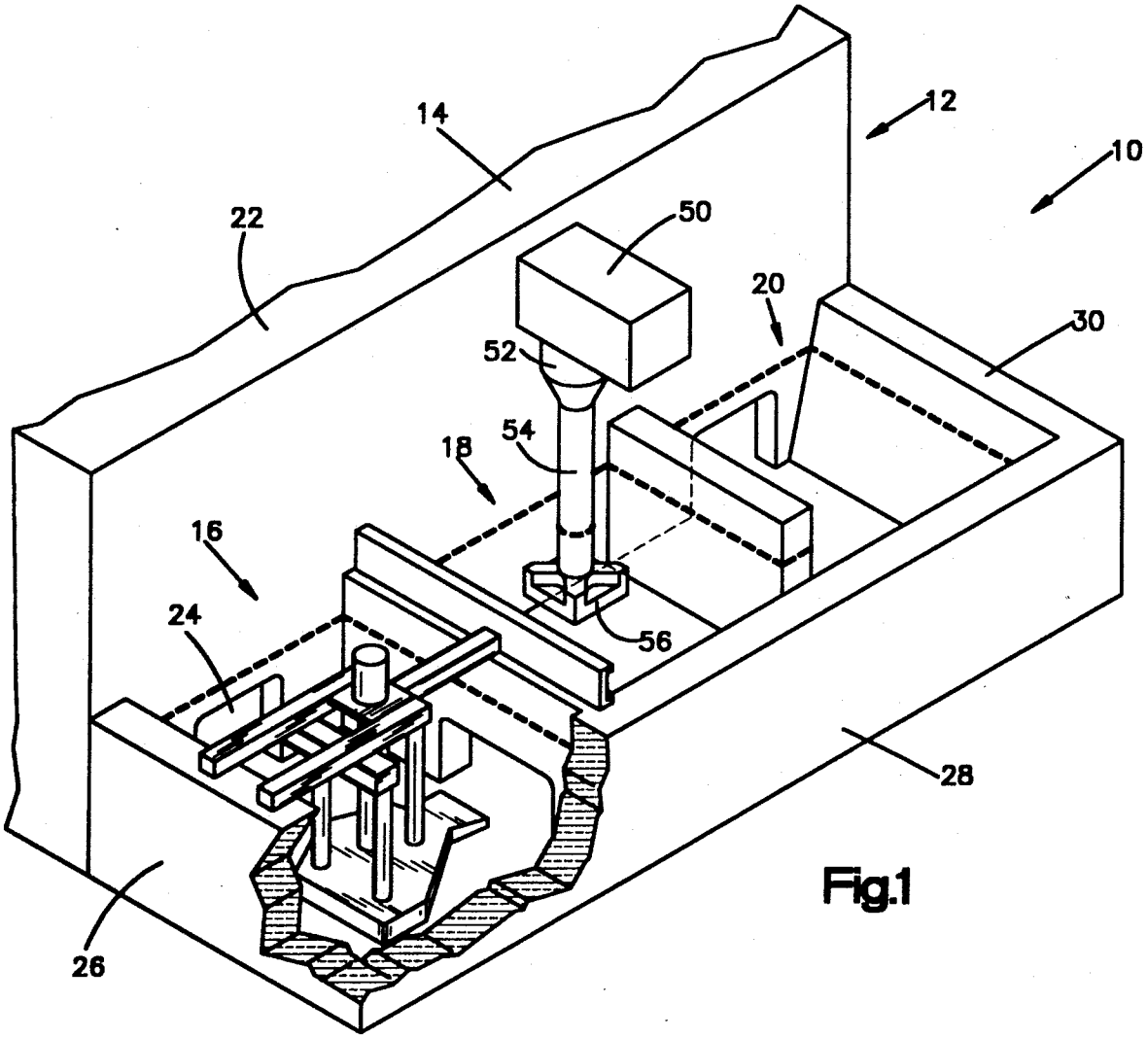
FIG. 1 is a schematic perspective view, with certain parts omitted for purposes of clarity of illustration, of apparatus according to the invention.
Figure 2:
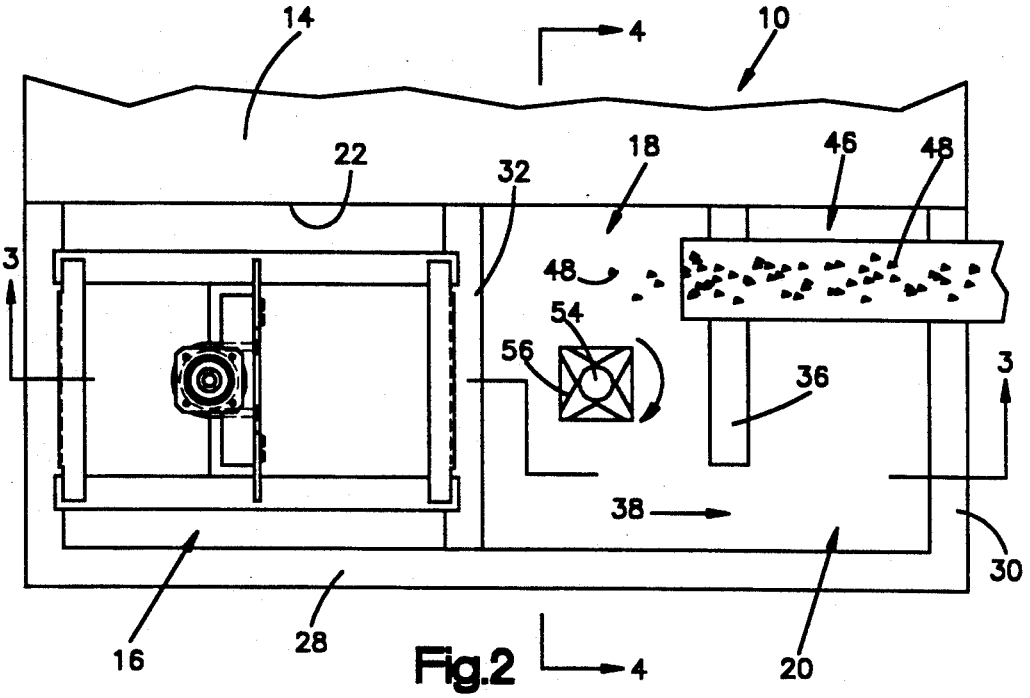
FIG. 2 is a top plan view of the apparatus of FIG.
Figure 3:
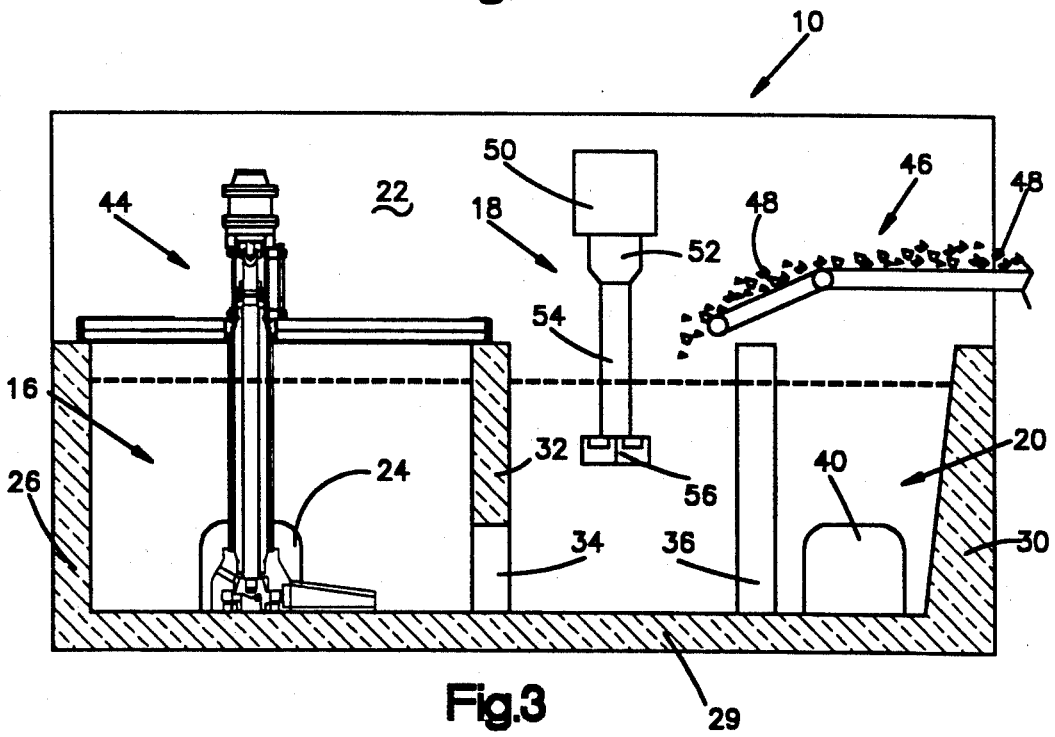
FIG. 3 is a cross-sectional view of the apparatus of FIG. 1 taken along a plane indicated by line 3—3 in FIG. 2.

Referring to FIGS. 1-3, apparatus for melting metal particles is indicated generally by the reference numeral 10. The apparatus 10 can be used in a variety of environments, and a typical one will be described here. A reverberatory furnace 12 includes a hearth 14 in fluid communication with a pump well 16, a charge well 18 and a skimming well 20. The hearth 14 includes a front wall 22 having an opening 24 that communicates with the pump well 16. A sidewall 26 defines a portion of the pump well 16. A front wall 28 and a floor 29 extend across the width of the furnace 12 and define a portion of the wells 16, 18, 20.

A sidewall 30 having a sloping inner surface connects the walls 22, 28 and defines a portion of the skimming well 20. A wall 32 extends between the walls 22, 28 and defines a portion of both the pump well 16 and the charge well 18. The wall 32 includes an opening 34 that permits fluid communication between the wells 16, 18. A wall 36 projects from the wall 22 and divides the wells 18, 20. The wall 36 is not in contact with the wall 28, thereby defining a space 38 that permits fluid communication between the wells 18, 20. The wall 22 includes an opening 40 that permits fluid communication between the skimming well 20 and the hearth 14.

Molten metal is disposed within the reverberatory furnace 12 and the wells 16, 18, 20. The surface of the molten metal is indicated by the dashed line 42. As used herein, reference to "molten metal" will be understood to mean any metal such as aluminum, copper, iron, and alloys thereof. The invention is particularly useful with aluminum and alloys thereof.

A circulation pump 44 is disposed within the pump well 16. The circulation pump 44 can be of any type, provided that it performs the essential function of circulating metal from the pump well 16 through the opening 34 into the charge well 18. Suitable circulation pumps are commercially available from The Carborundum Company, Metaullics Systems Division, 31935 Aurora Road, Solon, Ohio 44139 under the model designation M-30, et al.

Referring particularly to FIGS. 2 and 3, a conveyor 46 is disposed adjacent the charge well 18, forwardly of the front wall 22. Particles 48 of scrap metal are conveyed by the conveyor 46 for discharge into the charge well 18.

The mixing apparatus 10 includes a drive motor and support 50. The drive motor and support 50 are disposed above the charge well 18 at approximately a central location relative to the charge well 18. A coupling 52 projects from the underside of the drive motor and support 50. A vertically oriented, elongate shaft 54 projects downwardly from the underside of the coupling 52. An impeller 56 is rigidly secured to the shaft 54 at a location remote from the coupling 52. As will be apparent from the examination of FIGS. 1–3, the impeller 56 is disposed within the molten metal 42 at a location relatively far beneath the surface of the molten metal 42. For best performance, the impeller 56 should be disposed within the range of about 4–12 inches beneath the surface of the molten metal 42.

The shaft 54 and the impeller 56 usually will be made of graphite, particularly if the molten metal being treated is aluminum. Other materials such as ceramics or castable refractory compositions could be employed, if desired. If graphite is used, it preferably should be coated or otherwise treated to resist oxidation and erosion. Oxidation and erosion treatments for graphite parts are practiced commercially, and can be obtained from sources such as The Carborundum Company, Metaullics System Division, 31935 Aurora Road, Solon, Ohio 44139.

Figure 5:
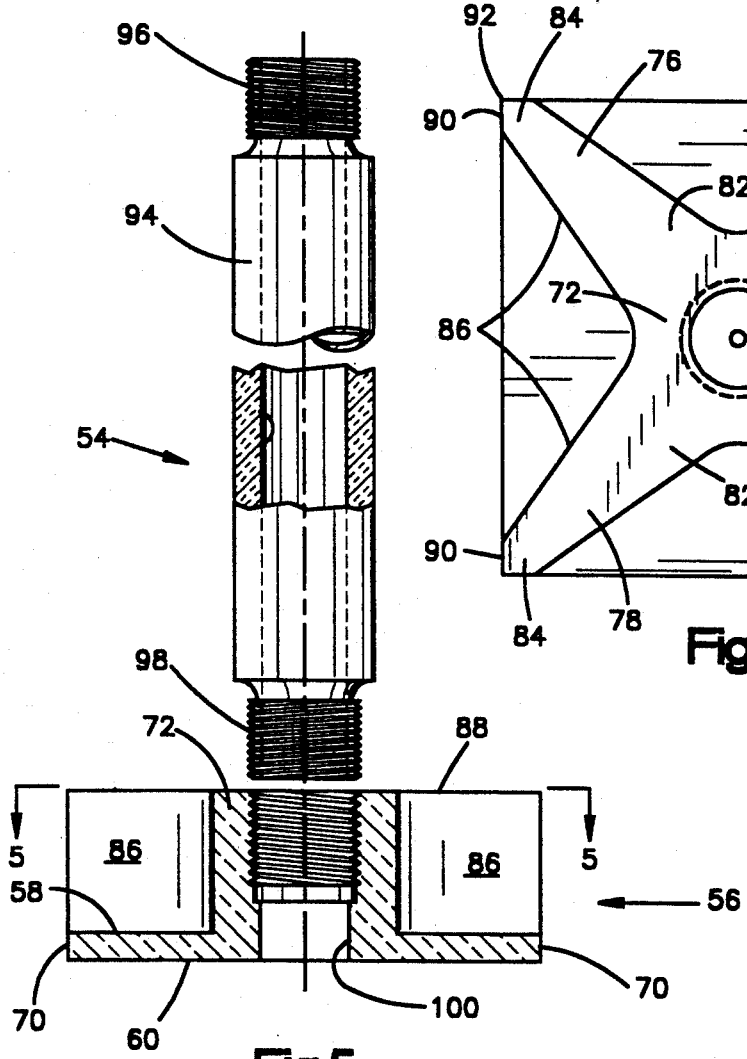
FIG. 5 is an enlarged view of the apparatus of FIG. 4, with an impeller and a shaft being illustrated in spaced relationship.
Figure 6:
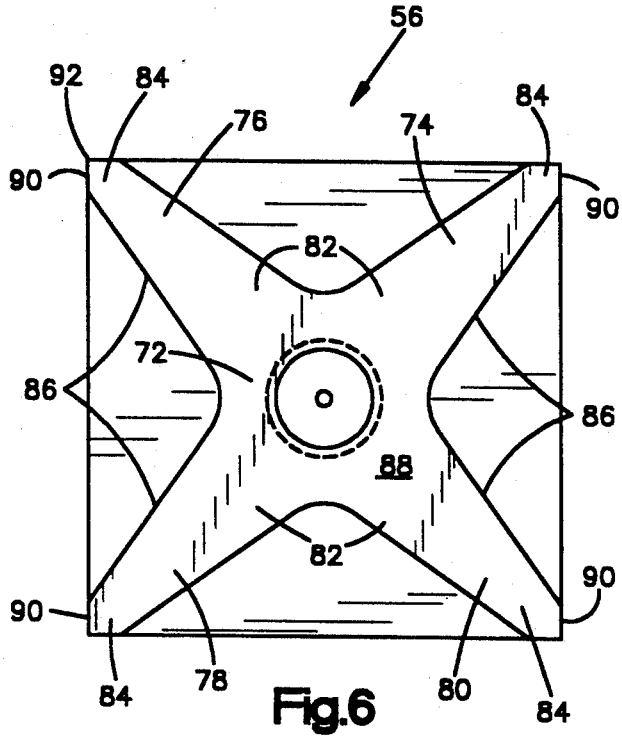
FIG. 6 is a top plan view of the impeller of FIG. 5.

Referring now to FIGS. 5 and 6, the impeller 56 includes a relatively thin rectangular prism having an upper face 58, a lower face 60, and sidewalls 62, 64, 66, 68. The faces 58, 60 are parallel with each other as are the sidewalls 62, 66 and the sidewalls 64, 68. The faces 58, 60 and the sidewalls 62, 64, 66, 68 are planar surfaces which define sharp, right-angled corners 70.

The sidewalls 62, 66 have a width identified by the letter A, while the sidewalls 64, 68 have a depth indicated by the letter B. The height of the impeller 56, that is, the distance between the upper and lower faces 58, 60, is indicated by the letter C. Preferably, dimension A is equal to dimension B and dimension C is equal to about 1/20 dimension A. Deviations from the foregoing dimensions are possible, but best performance will be obtained if dimensions A and B are equal to each other (the impeller 56 is square in plan view) and if the corners 70 are sharp and right-angled. Also, the corners 70 should extend perpendicular to the lower face 60 at least for a short distance above the lower face 60.

As illustrated, the corners 70 are perpendicular to the lower face 60 completely to their intersection with the upper face 58. It is possible, although not desirable, that the upper face 58 could be larger or smaller than the lower face 60 or that the upper face 58 could be skewed relative to the lower face 60; in either of these cases, the corners 70 would not be perpendicular to the lower face 60. The best performance is obtained when the corners 70 are exactly perpendicular to the lower face 60. It also is possible that the impeller 56 could be triangular, pentagonal, or otherwise polygonal in plan view, but it is believed that any configuration other than a rectangular, square prism produces reduced mixing action.

Figure 4:
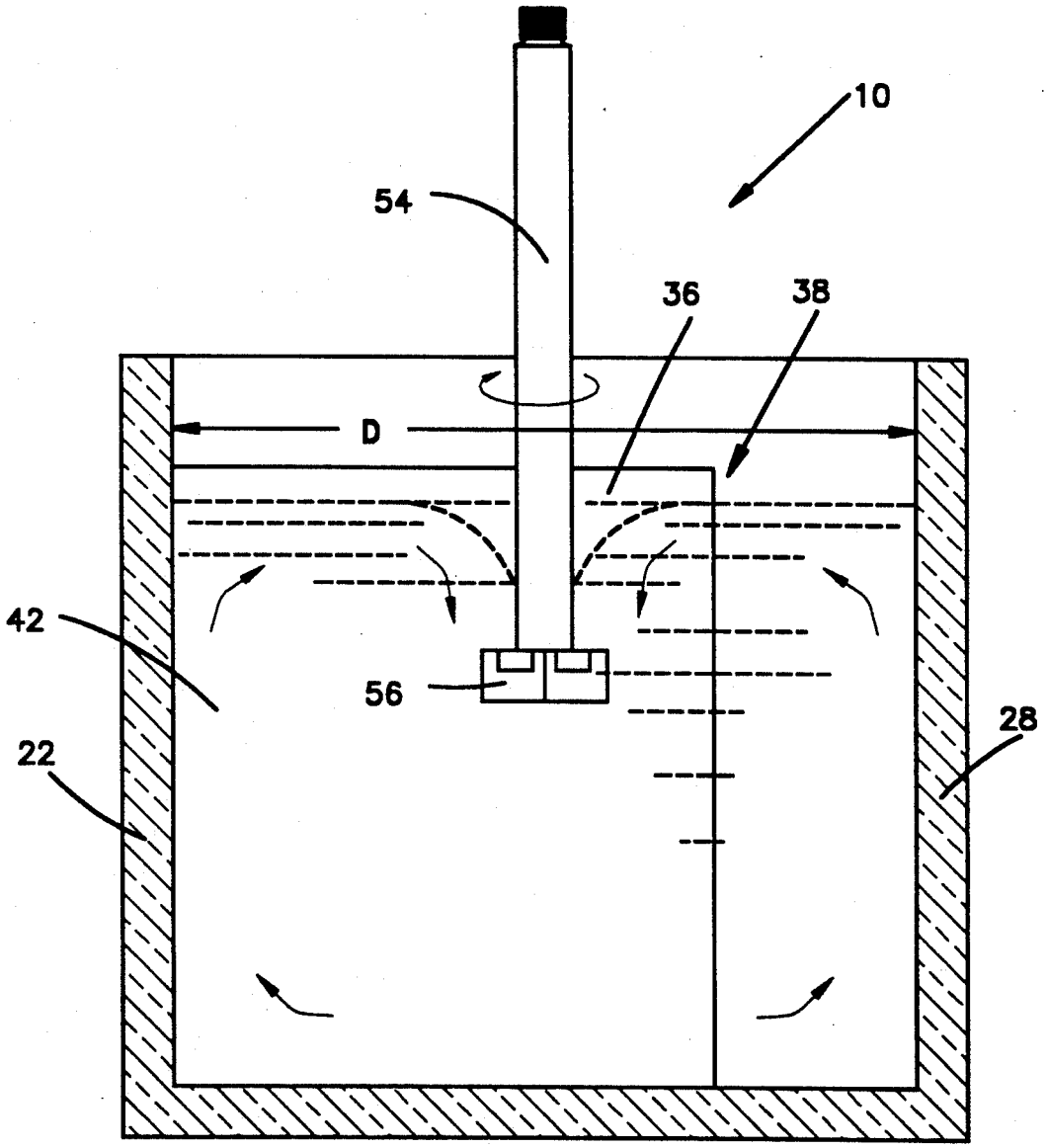
FIG. 4 is a cross-sectional view of the apparatus of FIG. 1, taken along a plane indicated by line 4—4 in FIG. 3.

The dimensions A and B also should be related to the dimensions of the charge well 18, if possible. In FIG. 4, the dimension D identifies the average inner diameter of the charge well 18. In particular, the impeller 56 has been found to perform best when the impeller 56 is centered within the charge well 18 and the ratio of dimensions A and D is within the range of 1:6 to 1:8. Although the impeller 56 will function adequately in a charge well 18 of virtually any size or shape, the foregoing relationships are preferred.

The impeller 56 includes an upstanding central portion, or hub, 72 that projects from the upper face 58 at the center thereof. A plurality of vanes 74, 76, 78, 80 extend radially outwardly from the hub 72. Each of the vanes 74, 76, 78, 80 includes a relatively thick inner portion 82 that is connected to the hub 72, a relatively sharp-edged tip portion 84 that is disposed at one of the corners 70, and a pair of opposed sidewalls 86 that taper smoothly from the inner portion 82 to the tip portion 84. The uppermost portions of the hub 72 and the vanes 74, 76, 78, 80 define a surface identified by the reference numeral 88 in FIG. 5. The surface 88 is parallel to the upper and lower faces 58, 60. Each tip portion 84 terminates in beveled sections 90 and a sharp edge 92 located at the intersection of the beveled sections 90. Each of the edges 92 is coincident with a corner 70.

As is apparent from an examination of FIGS. 5 and 6, the vanes 74, 76, 78, 80 are disposed generally perpendicular to the upper face 58. The vanes 74, 76, 78, 80 are rigidly connected to the upper face 58 so as to be strengthened thereby. The vanes 74, 76, 78, 80 are disposed at right angles to each other, that is, any given vane is disposed equidistantly between adjacent vanes. Moreover, the vanes 74, 78 include longitudinal axes that are aligned with each other and that extend from one corner 70 to the opposed corner 70. Similarly, the longitudinal axes of the vanes 76, 80 are aligned with each other such that the vanes 76, 80 extend from one corner 70 to the opposed corner 70.

The shaft 54 includes an elongate, cylindrical center portion 94 from which threaded upper and lower ends 96, 98 project. Normally the shaft 54 and the impeller 56 are solid. However, as disclosed in the Dispersing Gas Patent, the shaft 54 can include a longitudinally-extending bore that opens through the ends of the threaded portions 96, 98. If gas-dispersing capability is desired, the shaft 54 can be fabricated from a commercially available flux tube, or gas injection tube, merely by machining threads at each end of the tube. A typical flux tube suitable for use with the present invention has an outer diameter of 2.875 inches, a bore diameter of 0.75 inches and a length dependent upon the depth of the charge well 18.

As is illustrated in FIGS. 5 and 6, the lower end 98 is threaded into an opening 100 formed in the hub 72 until a shoulder defined by the cylindrical portion 94 engages the surface 88. When gas-dispersing capability is desired, the opening 100 extends completely through the impeller 56. The shaft 54 also could be rigidly connected to the impeller 56 by techniques other than a threaded connection, as by being cemented or pinned, although a threaded connection often is preferred for ease of assembly and disassembly. The use of coarse threads 4½" pitch, UNC) facilitates manufacture and assembly.

In operation of the apparatus 10, the circulation pump 44 is activated so as to cause molten metal 42 to flow from the hearth 14 through the opening 24 and laterally from the pump well 16 into the charge well 18 Metal within the charge well 18 eventually is directed through the space 38 into the skimming well 20, and thereafter into the hearth 14 by way of the opening 40.

As illustrated, the impeller 56 is rotated clockwise when viewed from above. For molten aluminum and alloys thereof, the impeller 56 should be rotated within the range of 50–300 revolutions per minute; approximately 85–90 revolutions per minute is preferred for best submergence and metal-melting efficiency. At this rate of rotation, the impeller 56 creates a smooth, strong vortex within the molten metal 42 contained within the charge well 18. As the conveyor 46 is activated, the particles 48 will be deposited onto the surface of the molten metal 42. Due to the mixing action imparted by the impeller 56, the particles 48 will be submerged substantially immediately for prompt melting. Due to the efficiency of the mixing action imparted by the impeller 56, virtually no oxides are formed and agglomerations are minimized or eliminated.

As has been indicated in the Dispersing Gas Patent, the apparatus 10 can be used to inject gas into the molten metal 42. As used herein, the term "gas" will be understood to mean any gas or combination of gases, including argon, nitrogen, chlorine, freon and the like, that have a purifying effect upon molten metals with which they are mixed. It is customary to introduce gases such as nitrogen, argon and chlorine into molten aluminum and molten aluminum alloys in order to remove undesirable constituents such as hydrogen gas, non-metallic inclusions, magnesium (de-magging) and alkali metals (lithium, sodium and calcium). The gases added to the molten metal react chemically with the undesired constituents to convert them to a form (such as a precipitate or a dross) that can be separated readily from the remainder of the molten metal. In order to obtain the best possible results, it is necessary that the gas be combined with the undesirable constituents efficiently. Such a result requires that the gas be disbursed in bubbles as small as possible, and that the bubbles be distributed uniformally throughout the molten metal.

As is described more completely in the Dispersing Gas Patent, when the apparatus 10 is used as a gas disperser, the bore in the shaft 54 is connected to a gas source (not shown). Upon immersing the impeller 56 in the molten metal 42 and pumping gas through the bore in the shaft 54, the gas will be discharged through the opening 100 in the form of large bubbles that flow outwardly along the lower face 60. Upon rotation of the shaft 54, the impeller 56 will be rotated. Assuming that the gas has a lower specific gravity then the molten metal, the gas bubbles will rise as they clear the lower edges of the sidewalls 62, 64, 66, 68. Eventually, the gas bubbles will be contacted by the sharp corners 70 and the edges 92. The bubbles will be sheared into finely divided bubbles which will be thrown outwardly and thoroughly mixed with the molten metal 42 which is being churned by the impeller 56. In the particular case of the molten metal 42 being aluminum and the treating gas being nitrogen, argon, or chlorine, or mixtures thereof, the shaft 54 should be rotated within the range of 200–350 revolutions per minute. Because there are four corners 70 and four edges 92, there will be 800–1,400 shearing edge revolutions per minute.

When the apparatus 10 is being used as a gas-disperser, it is expected that the impeller 56 will be positioned relatively close to the bottom of the vessel within which the apparatus 10 is disposed. Rotation of the impeller 56 will not cause a vortex to be formed at the surface of molten metal, or at best only nominal vortex action will be created. By using the apparatus according to the invention as a gas-disperser, high volumes of gas in the form of finely divided bubbles can be pumped through the molten metal 42, and the gas so pumped will have a long residence time. The apparatus 10 can pump gas at nominal flow rates of 1–2 cubic feet per minute (c.f.m.), and flow rates as high as 4–5 c.f.m. can be attained without choking. The apparatus 10 is very effective at dispersing gas and mixing it with the molten metal 42.

The apparatus 10 is exceedingly inexpensive and easy to manufacture, while being adaptable to all types of molten metal storage and transport systems, as well as all types of techniques for depositing particles onto the surface of molten metal. An important advantage of the apparatus 10 is that when the apparatus 10 is used as a scrap melter, the impeller 56 can be disposed relatively far beneath the surface of the molten metal. Accordingly, a stronger, deeper vortex can be created than can be created with prior vortex-creating devices. In turn, more metal particles can be melted in a given period of time, and with greater efficiency, than is possible with prior devices.

The apparatus 10 does not require precision-machined, intricate parts, and thereby has greater resistance to oxidation and erosion, as well as enhanced mechanical strength. Because the impeller 56 and the shaft 54 present solid surfaces to the molten metal 42, there are no orifices or channels that can be clogged by dross or foreign objects such as the particles 48 or agglomerations.

Although the invention as been described in its preferred form with a certain degree of particularity, it will be understood that the present disclosure of the preferred embodiment has been made only by way of example and that various changes may be resorted to without departing from the true spirit and scope of the invention as hereinafter claimed. It is intended that the patent shall cover, by suitable expression in the appended claims, whatever features of patentable novelty exist in the invention disclosed.

What is claimed is:

1. Apparatus for melting metal particles in a bath of molten metal, comprising:

an impeller, the impeller including a rectangular prism having upper and lower faces, four sidewalls, a width (A), a depth (B), and a height (C), with (A) being approximately equal to (B), the impeller defining a hub on the upper face, the impeller further including a plurality of vanes projecting radially outwardly of the hub, the vanes being disposed on the upper face, the impeller being immersible in the bath of molten metal; and an elongate, rotatable shaft rigidly connected to the impeller and projecting from the upper face, the shaft projecting from the upper surface of the bath.

2. The apparatus of claim 1, wherein the shaft is connected to the impeller by means of a threaded connection.

3. The apparatus of claim 1, wherein the shaft is connected to the hub.

4. The apparatus of claim 1, wherein the shaft is cylindrical.

5. The apparatus of claim 1, wherein the impeller and the shaft are made of a material selected from the group consisting of graphite, ceramic and castable refractory.

6. The apparatus of claim 1, wherein A equals B.

7. The apparatus of claim 1, wherein C equals about 1/20 A.

8. The apparatus of claim 1, wherein the molten metal is contained within a vessel having an inner diameter (D), the impeller is centered within the vessel, and the ratio of A to D is within the range of 1:6 to 1:8.

9. The apparatus of claim 1, wherein four vanes are provided, each vane being spaced equidistantly between adjacent vanes.

10. The apparatus of claim 9, wherein each vane extends from the hub toward a selected corner of the prism, each vane terminating at a corner of the prism at an angle equal to the angle of intersection of the sidewalls that intersect at that corner.

11. The apparatus of claim 10, wherein each of the vanes has an inner portion disposed adjacent the hub, the inner portion having a width equal to or greater than that of the hub, each vane tapering in width from the inner portion to a tip portion disposed at one of the corners of the prism, the tip portion having a width less than that of the inner portion.

12. The apparatus of claim 1, wherein the vanes are oriented generally perpendicular to the upper face.

13. The apparatus of claim 1, further comprising means for depositing the metal particles onto the surface of the molten metal in the vicinity of the impeller.

14. The apparatus of claim 13, wherein the means for depositing the metal particles is a conveyor.

15. The apparatus of claim 1, further comprising means included as part of the impeller and the shaft for dispersing gas into the molten metal.

16. The apparatus of claim 15, wherein the means for dispersing gas into the molten metal includes:

a gas discharge outlet that opens through the lower face of the prism; and means for conveying gas to the gas discharge outlet, whereby gas to be dispersed into molten metal can be pumped along the lower face of the impeller.

17. The apparatus of claim 16, wherein the gas discharge outlet is defined by an opening extending through the hub and the lower face of the impeller, and the means for conveying qas to the gas discharge outlet is a longitudinally extending bore formed in the shaft, the shaft being connected to the hub such that the bore in the shaft and the opening in the hub are in fluid communication with each other.

* * * * *